US006890118B2

(12) United States Patent
Oike

(10) Patent No.: US 6,890,118 B2
(45) Date of Patent: May 10, 2005

(54) WRITING INSTRUMENT

(75) Inventor: Shigeru Oike, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 18 days.

(21) Appl. No.: 10/883,651

(22) Filed: Jul. 6, 2004

(65) Prior Publication Data

US 2005/0008421 A1 Jan. 13, 2005

(30) Foreign Application Priority Data

Jul. 7, 2003 (JP) ..... P.2003-271595
Feb. 27, 2004 (JP) ..... P2004-053200

(51) Int. Cl.[7] ..... B43K 5/00
(52) U.S. Cl. ..... 401/202; 401/246
(58) Field of Search ..... 401/243, 245–247, 401/124, 202, 262

(56) References Cited

U.S. PATENT DOCUMENTS 2,509,234 A * 5/1950 Kahn ..... 401/246
5,927,887 A * 7/1999 Ishikawa et al. ..... 401/202
5,957,608 A * 9/1999 Matsumoto et al. ..... 401/202
6,428,235 B1 * 8/2002 Takanashi et al. ..... 401/202
6,626,600 B1 * 9/2003 Brand et al. ..... 401/202

FOREIGN PATENT DOCUMENTS

JP 09-039479 A 2/1997
JP 10-100585 A 4/1998

* cited by examiner

*Primary Examiner*—Gregory L. Huson
*Assistant Examiner*—Huyen Le
(74) *Attorney, Agent, or Firm*—Sughrue Mion, PLLC

(57) ABSTRACT

A writing instrument has a cap including an inner cylinder portion having an open end and a close end, a cylindrical outer cylinder portion having open ends, a plurality of connection rib integrally connected to an outer surface of the inner cylinder portion and extending in an axial direction and a plurality of vent hole respectively formed between adjacent ones of the connection ribs and a writing instrument body including a pen tip. The open end of the inner cylinder portion extends rearwardly of the connection ribs, the inner cylinder portion seals the pen tip when the cap is fitted on a pen tip side of the writing instrument body and an annular seal portion which is closely contact with an annular airtight portion on the pen tip side of the writing instrument body is provided on the outer peripheral surface of the open end portion of the inner cylinder portion.

24 Claims, 13 Drawing Sheets

WRITING INSTRUMENT

The present invention claims foreign priority to Japanese patent application no. 2004-053200, filed on Feb. 27, 2004 and Japanese patent application no. 2003-271595 filed on Jul. 7, 2003, the contents of which is incorporated herein by reference.

BACKGROUND OF THE INVENTION

1. Field of the Invention

The present invention relates to a writing instrument. It should be noted that, in the invention, the term "front" refers to a closed side of a cap and a pen tip side of a writing instrument body, whereas the term "rear" refers to an open side of the cap and an ink tank side of the writing instrument body.

2. Description of the Related Art

Conventionally, among the writing instruments of this type, as a cap for a writing instrument which is safe even if an infant swallows it, Japanese Patent Unexamined Publication JP-A-9-39479 discloses "a cap for a writing instrument characterized in that a seal portion for sealing a pen body by coming into close contact with a writing instrument body is formed on an inner peripheral surface of an opening portion of a bottomed cylindrical cap body, that a plurality of longitudinal ribs are formed on an outer periphery of the cap body to allow gaps between the longitudinal ribs to act as vent grooves, that a tailing end part of a skirt cylinder whose diameter is the same as that of the writing instrument body is connected to the cap body by connection ribs in the vicinity of the opening portion of the cap body shunting the seal portion, and that venting windows communicating with the vent grooves are formed between the connection ribs."

In addition, as a structure for discharging the air compressed and entrapped in a cap at the time of fitting the cap, Japanese Patent Unexamined Publication JP-A-10-100585 discloses "a structure for fitting a cap of a writing instrument concerning a cap formed by an inner cylinder portion for accommodating a pen tip and an outer cylinder portion having an annular retaining projecting edge formed on an upper portion of an inner wall surface and a retaining projection provided projectingly on a lower portion thereof. A vent hole communicating with the interior of the outer cylinder portion is formed in a bottom portion of an annular U-groove formed between the inner cylinder portion and the outer cylinder portion in an axial direction of a writing instrument. The inner wall surface of the outer cylinder portion of the cap is fitted to a writing instrument body. The writing instrument body has a bellows portion (corresponding to an ink reservoir member of this application) for temporarily storing excessively supplied ink. A writing portion is fixedly held which directly supplies ink to the pen tip through a supply cylinder communicating with the incorporated ink reservoir portion. An annular resilient member which is deformed by close contact with a bottom of the inner cylinder portion is provided on an upper edge of the writing instrument body, thereby rendering the vent hole of the cap closable."

The cap of the above-described Japanese Patent Unexamined Publication JP-A-9-39479 is so structured that a seal portion for sealing the pen body by coming into close contact with the writing instrument body is formed on the inner peripheral surface of the cap body (corresponding to the inner cylinder portion in this application). Therefore, when the cap is fitted, there is a possibility of the pen tip coming into contact with the seal portion, with the result that ink can attach to and smear the seal portion or can damage it, possibly causing the occurrence of faulty airtightness.

Particularly in the case of the cap disclosed in the above-described Japanese Patent Unexamined Publication JP-A-9-39479, if the ink is attached to the seal portion, there are possibilities that the ink attached to the seal portion becomes attached to the writing instrument body by the fitting of the cap, and that when the writing instrument body is gripped, the ink is attached to the hand, smearing the hand.

On the other hand, the cap fitting structure disclosed in the above-described Japanese Patent Unexamined Publication JP-A-10-100585 is so structured that an annular resilient member, which is a separate part, is provided on an upper edge of the writing instrument body, so that the parts and the manufacturing steps increase. As a result, the manufacturing cost increases, and it becomes difficult to provide the writing instrument at low cost.

In addition, in the first aspect of the present invention, if the annular seal portion is arranged to be provided on an outer peripheral surface of the inner cylinder portion rearwardly of the connection ribs, when during the molding of the cap, a core of a mold for molding the connection ribs and the annular seal portion is pulled out rearwardly from the cap after molding, connection-rib molding portions of the core of the mold can come into contact with the annular seal portion on the outer peripheral surface of the inner cylinder portion and damage the annular seal portion. Hence, there is a possibility that proper sealing characteristics cannot be obtained between the annular seal portion and the annular airtight portion of the writing instrument body.

SUMMARY OF THE INVENTION

The invention has been devised to overcome the above-described drawbacks of the conventional art, and its object is to provide a writing instrument which makes it possible to secure air passages even in the event that an infant swallows the cap by mistake, and which has no possibility of the pen tip coming into contact with the annular seal portion of the cap when the cap is fitted. Another object of the invention is to provide a writing instrument which has a cap fitting structure that has no possibility of pressurizing the air in the cap and entrainment of air in the ink tank of the writing instrument body during the cap fitting, and which brings down the manufacturing cost and provides the writing instrument at low cost. Still another object of the invention is to provide a writing instrument that makes it possible to avoid causing damage to the annular seal portion during the molding of the cap.

According to a first aspect of the present invention, there is provided a writing instrument having a cap including an inner cylinder portion having an open end and a close end, a cylindrical outer cylinder portion having open ends, a plurality of connection rib that extends in an axial direction of the cap, the connection ribs integrally connecting an outer surface of the inner cylinder portion and the outer cylinder portion, and a plurality of vent hole respectively formed between adjacent ones of the connection ribs, and a writing instrument body including a pen tip, wherein the open end of the inner cylinder portion rearwardly extends beyond the connection ribs, the inner cylinder portion seals the pen tip when the cap is fitted on a pen tip side of the writing instrument body and an annular seal portion which closely contacts with an annular airtight portion on the pen tip side of the writing instrument body is provided on the outer peripheral surface of the open end of the inner cylinder portion.

According to a second aspect of the present invention according to the first aspect of the present invention, wherein the writing instrument body further has an ink reservoir member having the pen tip at a front end thereof, a barrel in which the ink reservoir member is accommodated in a front portion thereof, an ink tank formed rearwardly of the ink reservoir member inside the barrel, wherein the ink reservoir member is adapted to temporarily store excess ink corresponding to a rise in the internal pressure within the ink tank, the annular airtight portion is provided on an inner peripheral surface of an opening portion of a front end of the barrel, an outwardly oriented protrusion is provided on an outer peripheral surface of the barrel rearwardly of the annular airtight portion, and an inwardly oriented protrusion for riding over and being engaged with the outwardly oriented protrusion is provided on an inner peripheral surface of the outer cylinder portion rearwardly of the annular seal portion of the cap.

According to a third aspect of the present invention according to the first aspect of the present invention, wherein the outside diameter of the annular seal portion is smaller than the outside diameter of the inner cylinder portion between the connection ribs.

According to a fourth aspect of the present invention according to the first aspect of the present invention, wherein the cap is made of a synthetic-resin.

According to a fifth aspect of the present invention according to the fourth aspect of the present invention, wherein the synthetic-resin is selected from at least one of polypropylene resin, polyethylene resin, polyester resin, polycarbonate resin and ABS resin.

According to a sixth aspect of the present invention according to the first aspect of the present invention, wherein the cap is formed by an injection molding method.

According to a seventh aspect of the present invention according to the first aspect of the present invention, wherein the cap further includes a clip integrally formed on the outer surface of the outer cylinder portion, wherein a circumferential thickness of the connection rib located in the vicinity of an attached proximal portion of the clip is larger than the thickness of the other connection ribs.

According to an eighth aspect of the present invention according to the first aspect of the present invention, wherein a plurality of axially extending longitudinal ribs is integrally formed on the outer peripheral surface of the inner cylinder portion.

According to a ninth aspect of the present invention according to the eighth aspect of the present invention, wherein the rear ends of the axially extending longitudinal ribs connect to the front ends of the outer cylinder.

According to a tenth aspect of the present invention according to the ninth aspect of the present invention, wherein a plurality of vent groove are formed between the respective axially extending longitudinal ribs, and the rear ends of the vent grooves connect to a front end of the vent hole of the connection ribs.

According to an eleventh aspect of the present invention according to the first aspect of the present invention, wherein the annular airtight portion is an annular smooth surface.

According to a twelfth aspect of the present invention according to the first aspect of the present invention, wherein the annular airtight portion is an annular protrusion.

According to a thirteenth aspect of the present invention according to the second aspect of the present invention, wherein a rear surface of the outwardly oriented protrusion is an inclined surface in such a manner that the outside diameter of the outwardly oriented protrusion becomes smaller toward the rear of the cap.

According to a fourteenth aspect of the present invention according to the first aspect of the present invention, wherein an axial close-contact sliding length defined between the annular seal portion and the annular airtight portion is in a range of 0.1 mm to 1.0 mm.

According to a fifteenth aspect of the present invention according to the fourteenth aspect of the present invention, wherein the axial close-contact sliding length is in a range of 0.1 mm to 0.5 mm.

According to a sixteenth aspect of the present invention according to the second aspect of the present invention, wherein a plurality of shaking-preventing spot-like projection dispersed in a circumferential direction are integrally formed on the outer peripheral surface of the barrel rearwardly of the outwardly oriented protrusion.

According to a seventeenth aspect of the present invention according to the first aspect of the present invention, wherein the pen tip is made of a fiber-bundle resin processed part.

According to an eighteenth aspect of the present invention according to the first aspect of the present invention, wherein the annular seal portion is constituted by an annular smooth surface.

According to a nineteenth aspect of the present invention according to the first aspect of the present invention, wherein the annular seal portion is formed by an annular protrusion.

According to a twentieth aspect of the present invention according to the second aspect of the present invention, wherein a detent protrusion is integrally formed on the inner peripheral surface of the barrel rearwardly of the annular airtight portion, and the detent protrusion rides over and is engaged with the ink reservoir member.

According to a twenty first aspect of the present invention according to the twentieth aspect of the present invention, wherein the detent protrusion is formed rearwardly of the outwardly oriented protrusion.

According to a twenty second aspect of the present invention according to the twentieth aspect of the present invention, wherein the detent protrusion is formed forwardly of the outwardly oriented protrusion.

According to a twenty third aspect of the present invention according to the first aspect of the present invention, wherein an outer-cylinder-portion connecting side of a rear end portion of the connection rib is extended and provided rearwardly of an inner-cylinder-portion connecting side of the connection rib.

According to a twenty fourth aspect of the present invention according to the twenty third aspect of the present invention, wherein the outer-cylinder-portion connecting side of the rear end portion of the connection rib serves as an abutment wall portion for abutment against the pen tip side of the writing instrument body when the cap is fitted.

DETAILED DESCRIPTION OF THE PREFERRED EMBODIMENT

Figure 1:
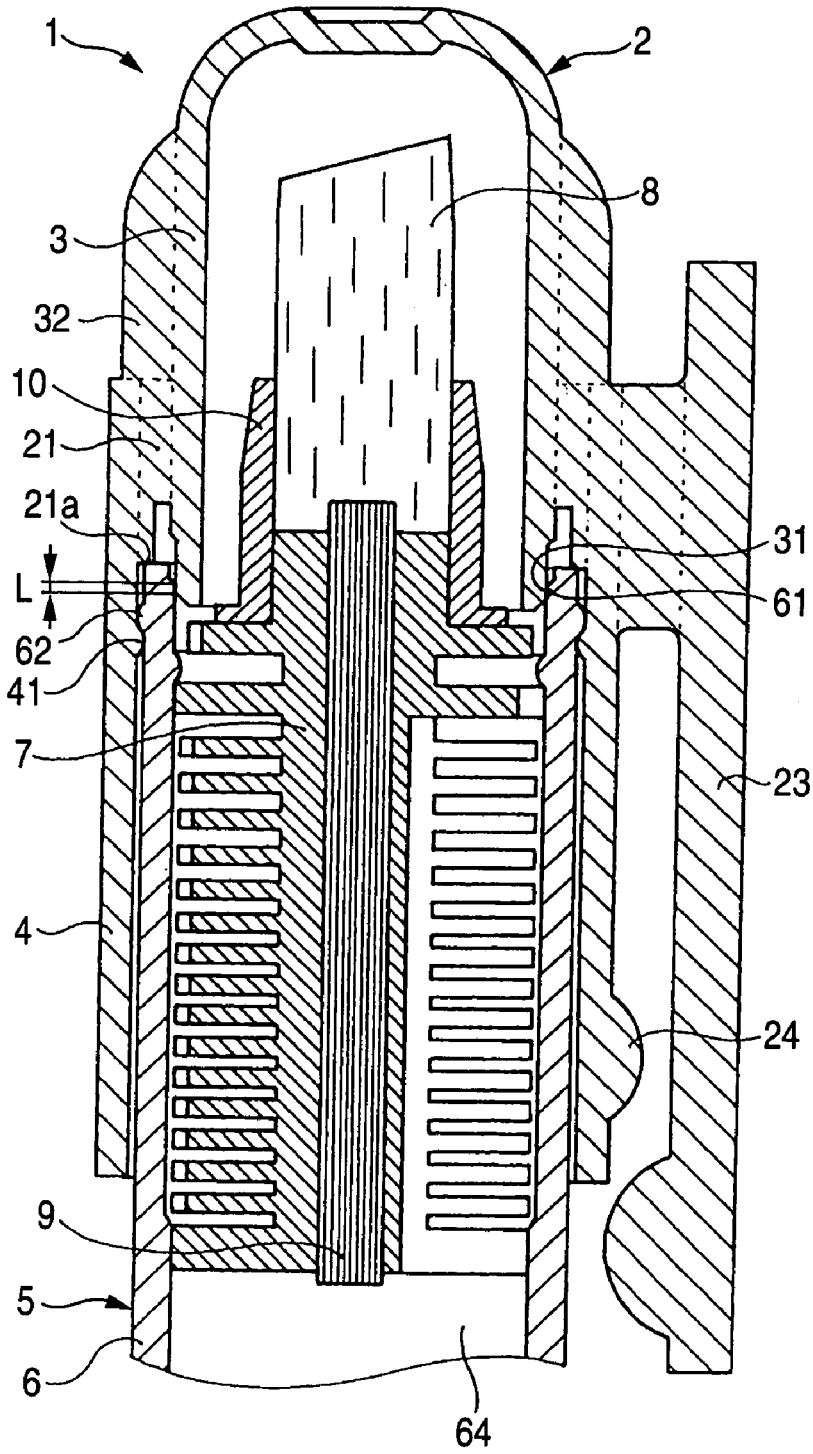
FIG. 1 is a longitudinal cross-sectional view of essential portions illustrating a cap fitted state in accordance with a first embodiment of the invention.
Figure 2:
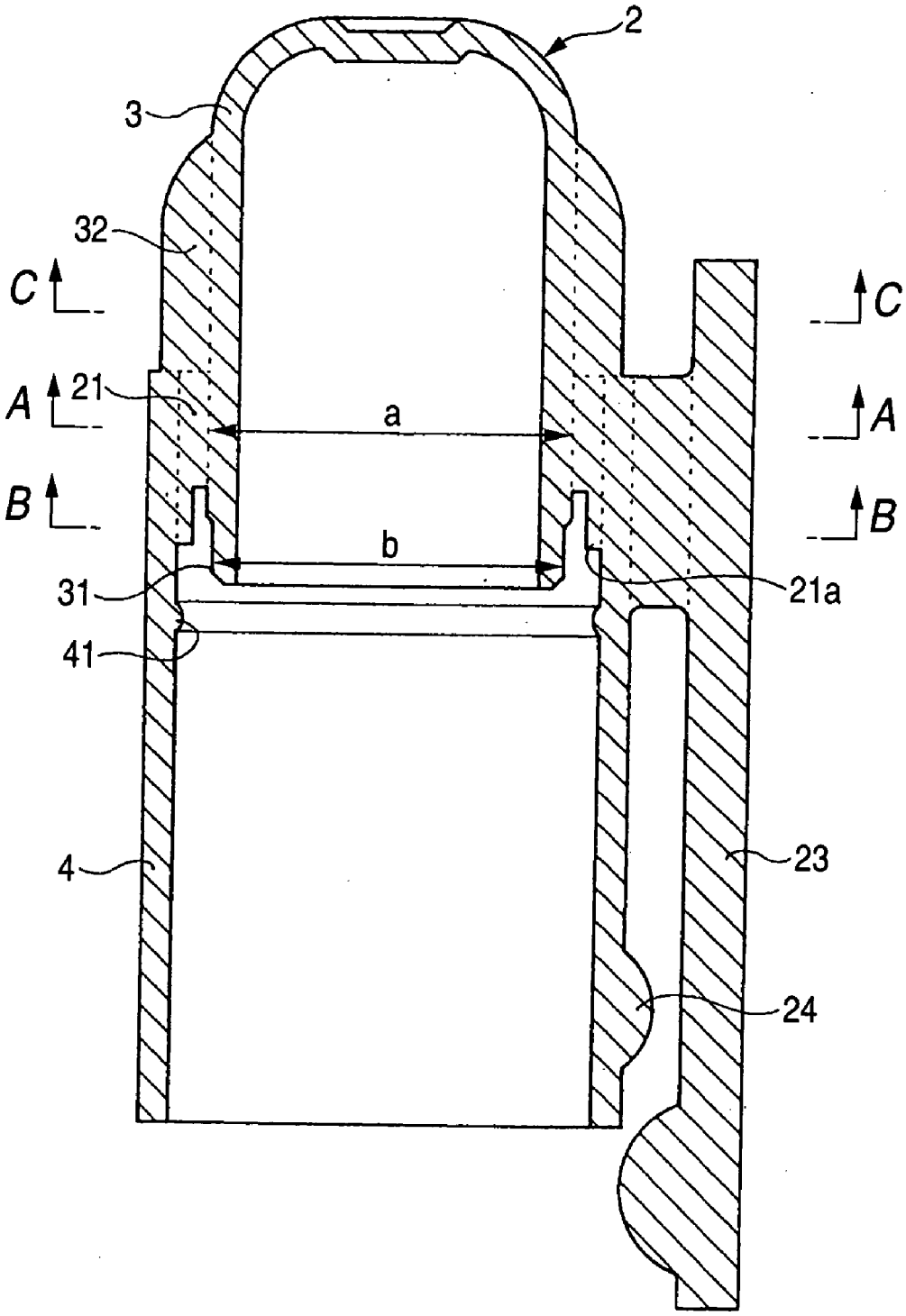
FIG. 2 is a longitudinal cross-sectional view illustrating the cap shown in FIG. 1.
Figure 3:
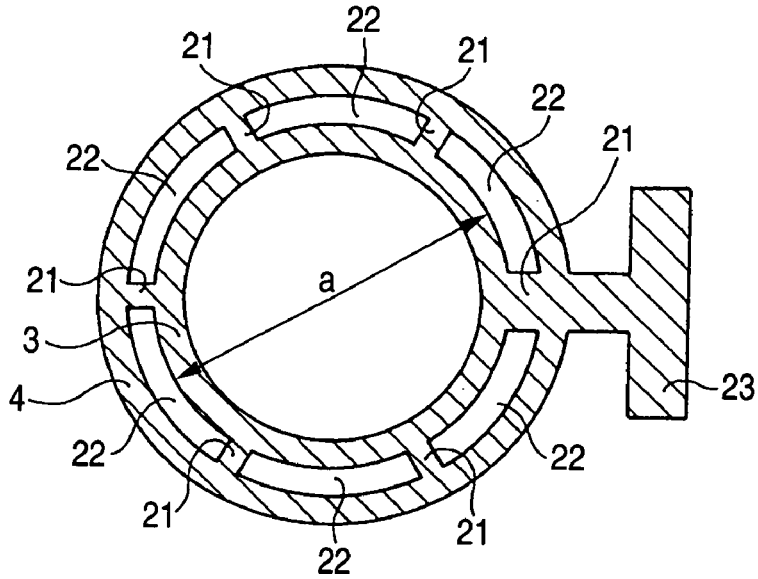
FIG. 3 is a cross-sectional view taken along line A—A in FIG. 2.
Figure 4:
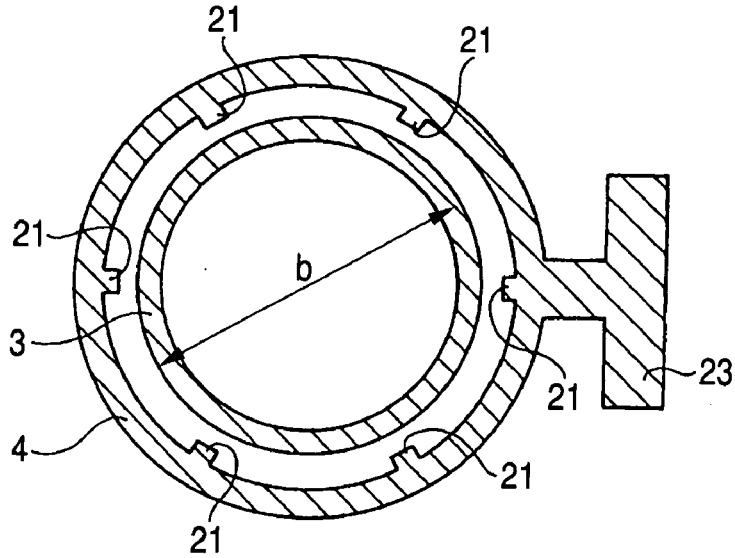
FIG. 4 is a cross-sectional view taken along line B—B in FIG. 2.
Figure 5:
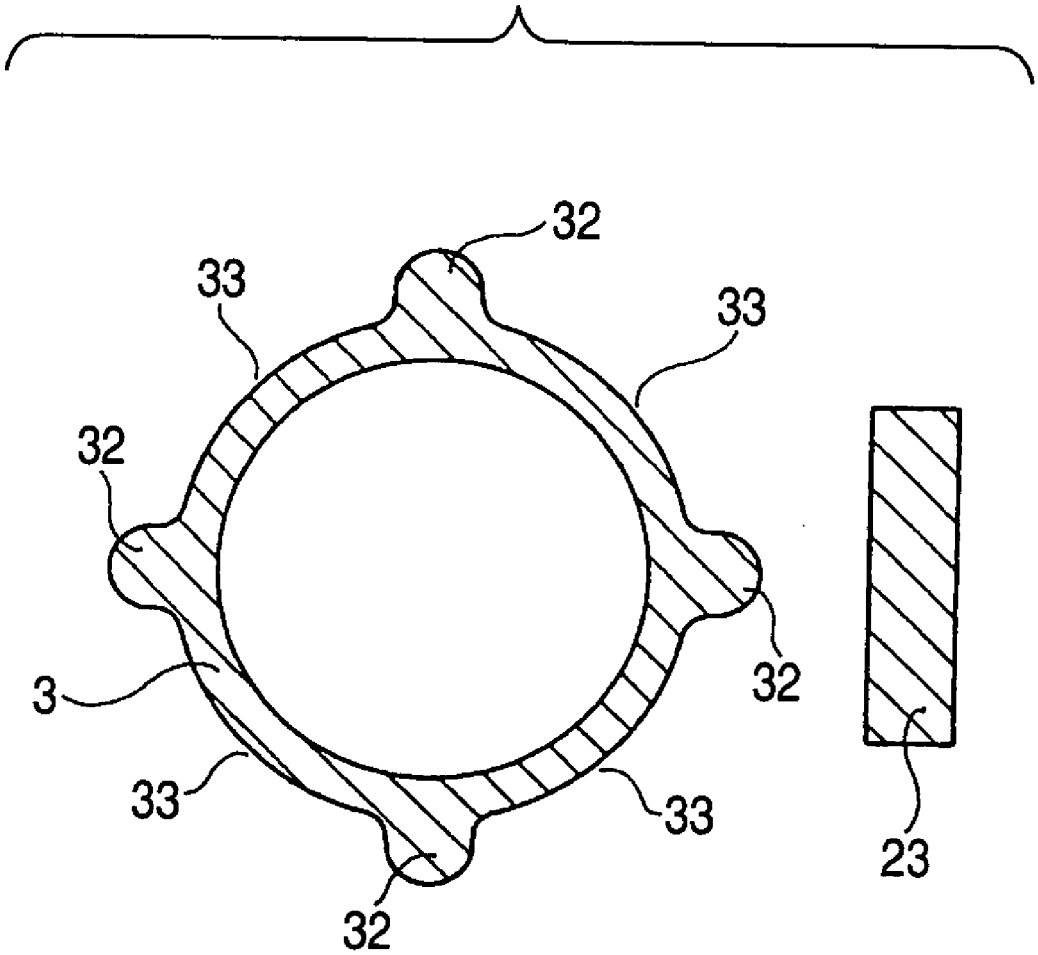
FIG. 5 is a cross-sectional view taken along line C—C in FIG. 2.

Referring now to the drawings, a description will be given of the best mode for carrying out the invention.

[First Embodiment]

FIGS. 1 to 6 illustrate a first embodiment of a writing instrument 1 in accordance with the invention. In this embodiment, the writing instrument 1 is comprised of a cap 2 and a writing instrument body 5, the cap 2 being detachably fitted to the pen tip side of the writing instrument body 5. FIG. 1 shows a state in which the cap 2 is fitted on the pen tip side of the writing instrument body. 5.

(Cap)

FIGS. 2 to 5 illustrate the cap 2 in accordance with this embodiment. The cap 2 is obtained by injection molding of a synthetic resin (e.g., polypropylene resin, polyethylene resin, polyester resin, polycarbonate resin, ABS resin, or the like). The cap 2 is comprised of a bottomed cylindrical inner cylinder portion 3 with its front end closed and its rear end open; a cylindrical outer cylinder portion 4 which is connected to an outer peripheral surface of the inner cylinder portion 3 by means of a plurality of connection ribs 21 extending in an axial direction, and whose opposite ends are open; and a clip 23 which is integrally provided continuously on an outer surface of the outer cylinder portion 4 and extending in the axial direction. A projection 24 is formed on an outer surface of the outer cylinder portion 4 which faces the reverse surface of the clip 23.

A rear end opening portion of the inner cylinder portion 3 projects rearwardly of rear ends of the connection ribs 21. An annular seal portion 31 constituted by an annular smooth surface is integrally formed on an outer peripheral surface of the rear end opening portion of the inner cylinder portion 3. The outside diameter b of the annular seal portion 31 is set to be smaller than the outside diameter a of the inner cylinder portion 3 between the connection ribs 21 (i.e., the outside diameter a of the outer peripheral surface of the inner cylinder portion 3 on the inner side of vent holes 22). Therefore, at the time of mold release in injection molding, a core of a mold for molding the connection ribs 21 is prevented from coming into contact with the annular seal portion 31 after molding, and from damaging the annular seal portion 31. It should be noted that the annular seal portion 31 may be formed by an annular protrusion.

Axially extending vent holes 22 are respectively provided penetratingly between adjacent ones of the connection ribs 21, and rear ends of the vent holes 22 communicate with an annular gap between the outer peripheral surface of a rear end portion of the inner cylinder portion 3 and the inner peripheral surface of the outer cylinder portion 4. In this embodiment, six connection ribs 21 are provided at equal intervals, with the result that six vent holes 22 are formed. An outer-cylinder-portion connecting side of a rear end portion of each connection rib 21 extends more rearwardly than an inner-cylinder-portion connecting side thereof, and is located slightly forwardly of the annular seal portion 31 (an opening end of the inner cylinder portion 3). The outer-cylinder-portion connecting side of the rear end portion of each connection rib 21 serves as an abutment wall portion 21*a* for abutment against a front end of a barrel 6 when the cap is fitted. The inner-cylinder-portion connecting side of the rear end portion of each connection rib 21 is located sufficiently forwardly of the opening end of the inner cylinder portion 3. Therefore, when the annular seal portion 31 on the outer peripheral surface of the inner cylinder portion 31 and an annular airtight portion 61 on an inner peripheral surface of the barrel 6 are fitted to each other, the elastic deformation of the annular seal portion 31 in a radially inward direction is facilitated. In addition, the circumferential thickness of only the connection rib 21 located in the vicinity of an attached proximal portion of the clip 23 is set to be large, so that the attachment strength of the clip 23 is improved.

In addition, a plurality of (specifically, four) axially extending longitudinal ribs 32 are integrally formed at equal intervals on the outer peripheral surface of the inner cylinder portion 3 forwardly of the connection ribs 21. Rear ends of the longitudinal ribs 32 are connected to front ends of the outer cylinder portion 4. Further, vent grooves 33 are respectively formed between adjacent ones of the longitudinal ribs 32, and rear ends of the vent grooves 33 communicate with front ends of the vent holes 22 between the connection ribs 21.

In addition, an annular inwardly oriented protrusion 41 is integrally formed on the inner peripheral surface of the outer cylinder portion 4 located slightly rearwardly of the annular seal portion 31. When the cap is fitted, the inwardly oriented protrusion 41 rides over and is engaged with an outwardly oriented protrusion 62 of the barrel 6.

Even in the event that an infant swallows the cap 2 of this embodiment by mistake, it is possible to secure axial air passages by virtue of the interior of the outer cylinder portion 4, the annular gap between the outer peripheral surface of the rear end portion of the inner cylinder portion 3 and the inner peripheral surface of the outer cylinder portion 4, the vent holes 22 between the connection ribs 21, and the vent grooves 33 between the longitudinal ribs 32. In addition, since the cap 2 of this embodiment has the annular seal portion 31 on the outer peripheral surface of the rear end opening portion of the inner cylinder portion 3, the pen tip 8 is prevented from being brought into contact with the annular seal portion 31.

(Writing Instrument Body)

Figure 6:
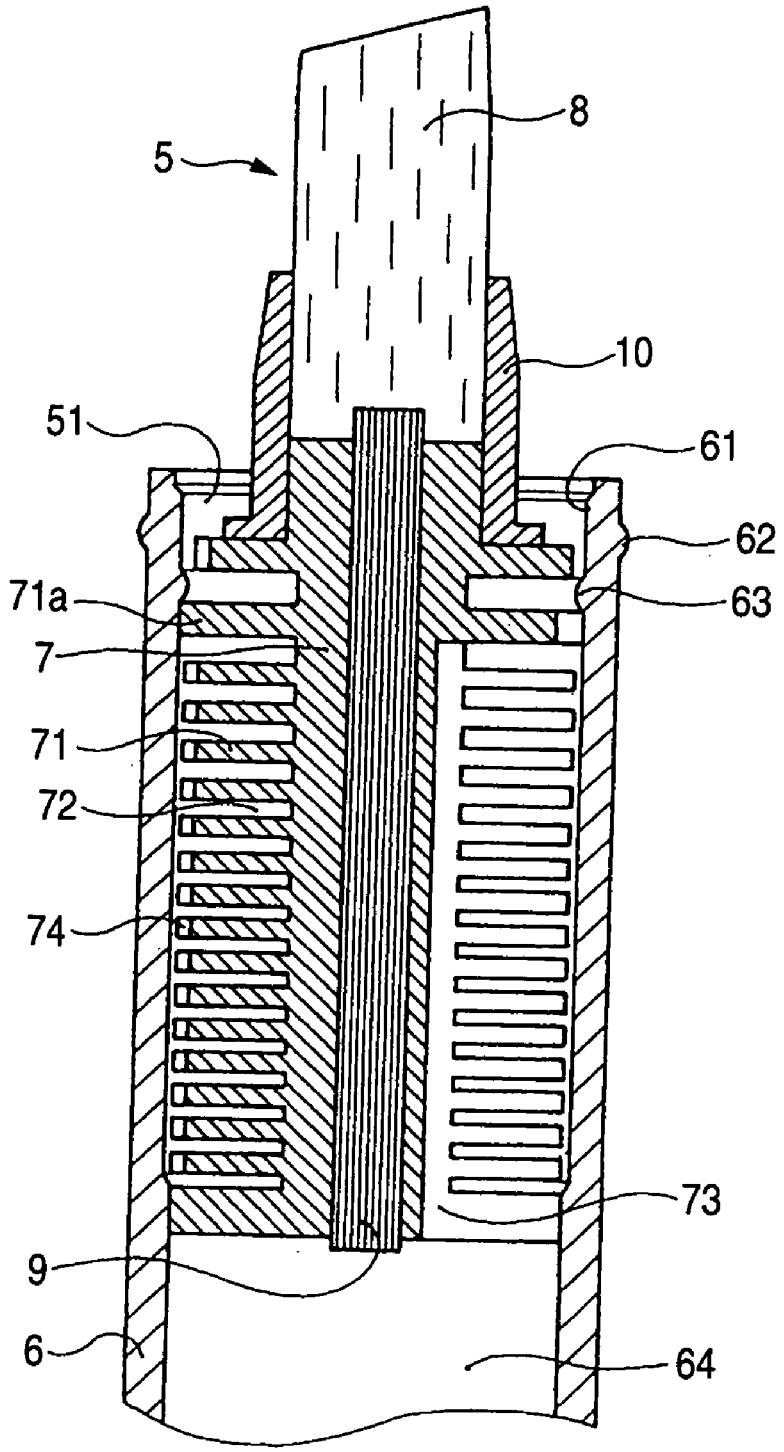
FIG. 6 is a longitudinal cross-sectional view of essential portions illustrating a writing instrument body shown in FIG. 1.

FIG. 6 shows the writing instrument body 5 in accordance with this embodiment. The writing instrument body 5 is comprised of the bottomed cylindrical barrel 6 with its front end open; an ink reservoir member 7 consisting of a plurality of comb teeth 71 which are fitted in a front-end opening portion of the barrel 6; a pen tip 8 which is held at a front end of the ink reservoir member 7; and an ink guiding core 9 connected to the pen tip 8 and inserted and fitted in an axial hole of the ink reservoir member 7.

The barrel 6 is obtained by injection molding of a synthetic resin (e.g., polypropylene resin). An ink tank 64 for directly storing the ink is formed in the rear of the ink reservoir member 7 inside the barrel 6. An annular recess 51 which is forwardly open is formed in the front-end opening portion of the barrel 6. The annular recess 51 exposes an inner peripheral surface of the front-end opening portion of the barrel 6, and the annular airtight portion 61 constituted by an annular smooth surface is integrally formed on the inner peripheral surface of the front-end opening portion of the barrel 6. It should be noted that the annular airtight portion 61 may be an annular protrusion.

In addition, the outwardly oriented protrusion 62 is integrally formed on the outer peripheral surface of the barrel 6 slightly rearwardly of the annular airtight portion 61. When the cap is fitted, the outwardly oriented protrusion 62 rides over and is engaged with the inwardly oriented protrusion 41 of the outer cylinder portion 4. A rear surface of the outwardly oriented protrusion 62 is shaped in the form of an inclined surface (e.g., a tapered surface or a curved surface) in which its outside diameter becomes smaller toward the rear. As a result, in a state in which the inwardly oriented protrusion 41 has ridden over and has been engaged with the outwardly oriented protrusion 62 (i.e., in a cap fitted state), the front surface of the inwardly oriented protrusion 41 is set in a state of being pressed rearwardly by the rear surface of the outwardly oriented protrusion 62. Accordingly, in the cap fitted state, the abutment wall portion 21*a* and the front end of the barrel 6 abut against each other in the axial direction. At the same time, the inwardly oriented protrusion 41 is pressed rearwardly by the rear surface of the outwardly oriented protrusion 62. Hence, the rattling of the cap 2 is prevented. It should be noted that either one of the inwardly oriented protrusion 41 and the outwardly oriented protrusion 62 may be formed by a plurality of circumferentially dispersed spot-like projections.

An annular detent protrusion 63 is integrally formed on the inner peripheral surface of the barrel 6 rearwardly of the outwardly oriented protrusion 62. The detent protrusion 63 rides over and is engaged with a supporting comb tooth 71*a* having a larger outside diameter than the other comb teeth 71 of the ink reservoir member 7, thereby preventing the ink reservoir member 7 from coming off. Since the front end portion of the barrel 6 located forwardly of the detent protrusion 63 (i.e., the front end portion of the barrel 6 having the annular airtight portion 61 and the outwardly oriented protrusion 62) is in a state of noncontact with the ink reservoir member 7, the insertion of the ink reservoir member 7 does not affect the inside dimension of the annular airtight portion 61 and the outside dimension of the outwardly oriented protrusion 62.

The ink reservoir member 7 is obtained by injection molding of a synthetic resin (e.g., ABS resin). The ink reservoir member 7 includes the plurality of disc-shaped comb teeth 71, ink reservoir grooves 72 respectively formed between adjacent ones of the comb teeth 71; an ink guide slit 73 provided in such a manner as to penetrate the plurality of comb teeth 71 in the axial direction; and notch-like air grooves 74 respectively formed in the comb teeth 71. In addition, the axial hole is penetratingly provided in an axial center of the ink reservoir member 7, and the ink guide core 9 (e.g., a synthetic-resin extrusion molded part or a fiber-bundle resin processed part) is inserted and fitted in the axial hole of the ink reservoir member 7. Further, the pen tip 8 (e.g., a fiber-bundle resin processed part) is fitted to the front end of the ink reservoir member 7 by means of an annular pen-tip holding member 10. The annular pen-tip holding member 10 holds the outer peripheral surface of a rear portion of the pen tip 8, and is fitted over an outer peripheral surface of a front end portion of the ink reservoir member 7. A front end of the ink guiding core 9 pierces a rear end of the pen tip 8 and is connected thereto, while a rear end of the ink guiding core 9 is exposed in the ink tank 64.

The axial close-contact sliding length L between the annular seal portion 31 and the annular airtight portion 61 (namely, the axial close-contact sliding length L from the time the close contact between the annular seal portion 31 and the annular airtight portion 61 is started until it is completed) should preferably be in the range of 0.1 mm to 1.0 mm (preferably, 0.1 mm to 0.5 mm). As a result of it, a sufficient sealing characteristic is obtained between the annular seal portion 31 and the annular airtight portion 61, and it is possible to sufficiently avoid pressurizing the air inside the inner cylinder portion 3 when the cap is fitted. If the close-contact sliding length L is smaller than 0.1 mm, a sufficient sealing characteristic cannot be obtained between the annular seal portion 31 and the annular airtight portion 61, and there is a possibility that the sealing of the pen tip 8 becomes incomplete. On the other hand, if the close-contact sliding length L is greater than 1.0 mm, there is a possibility that when the cap is fitted, the air inside the inner cylinder portion 3 is pressurized, and the pressurized air enters the ink tank 64. Incidentally, in this embodiment, the close-contact sliding length L is set to 0.3 mm.

As described above, the structure for fitting the writing instrument body 5 and the cap 2 becomes a structure which renders separate members such as an annular resilient member and the like unnecessary, brings down the manufacturing cost, and practically does not pressurize the air inside the inner cylinder portion 3.

[Second Embodiment]

Figure 7:
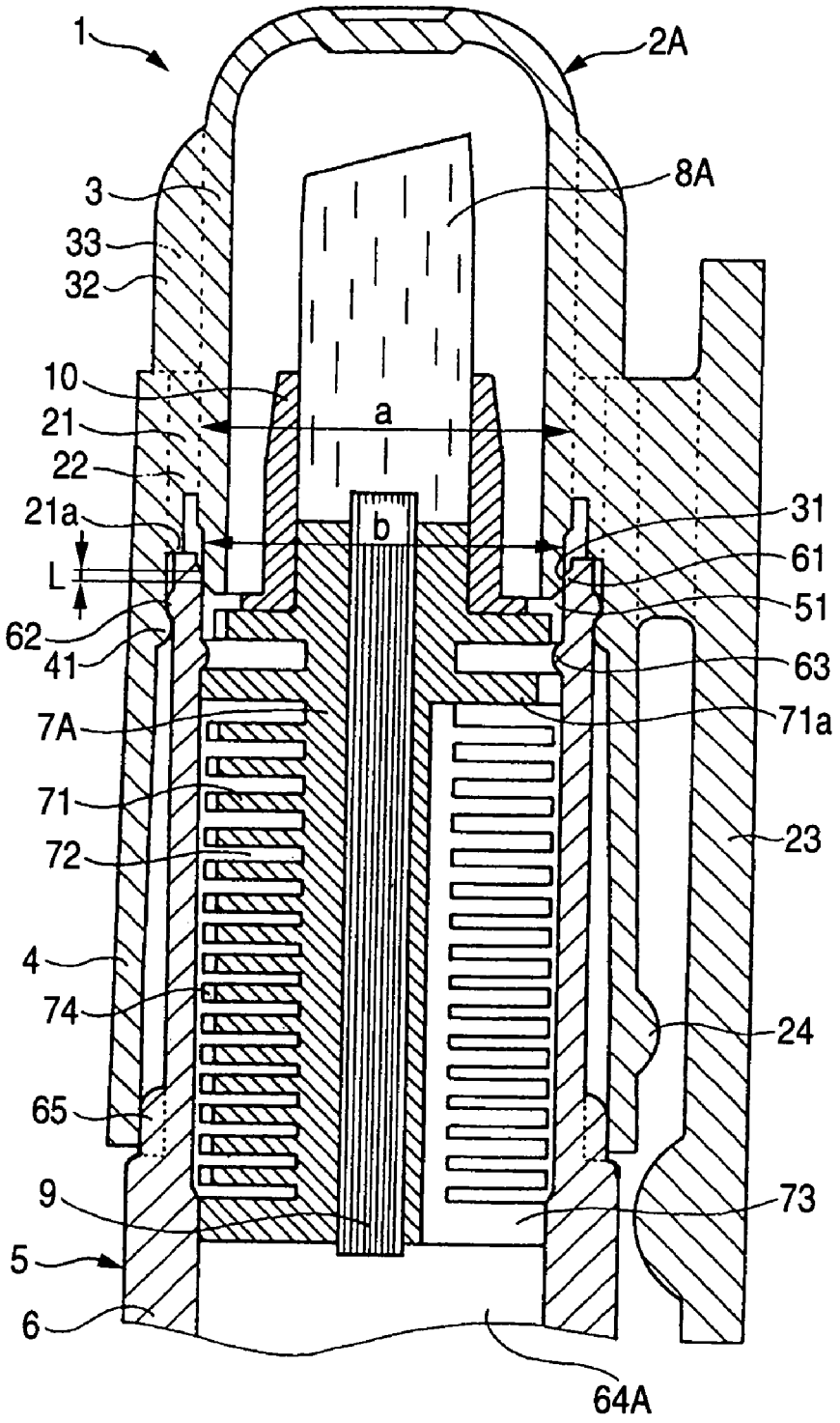
FIG. 7 is a longitudinal cross-sectional view of essential portions illustrating the cap fitted state of one pen tip side in accordance with a second embodiment of the invention.
Figure 8:
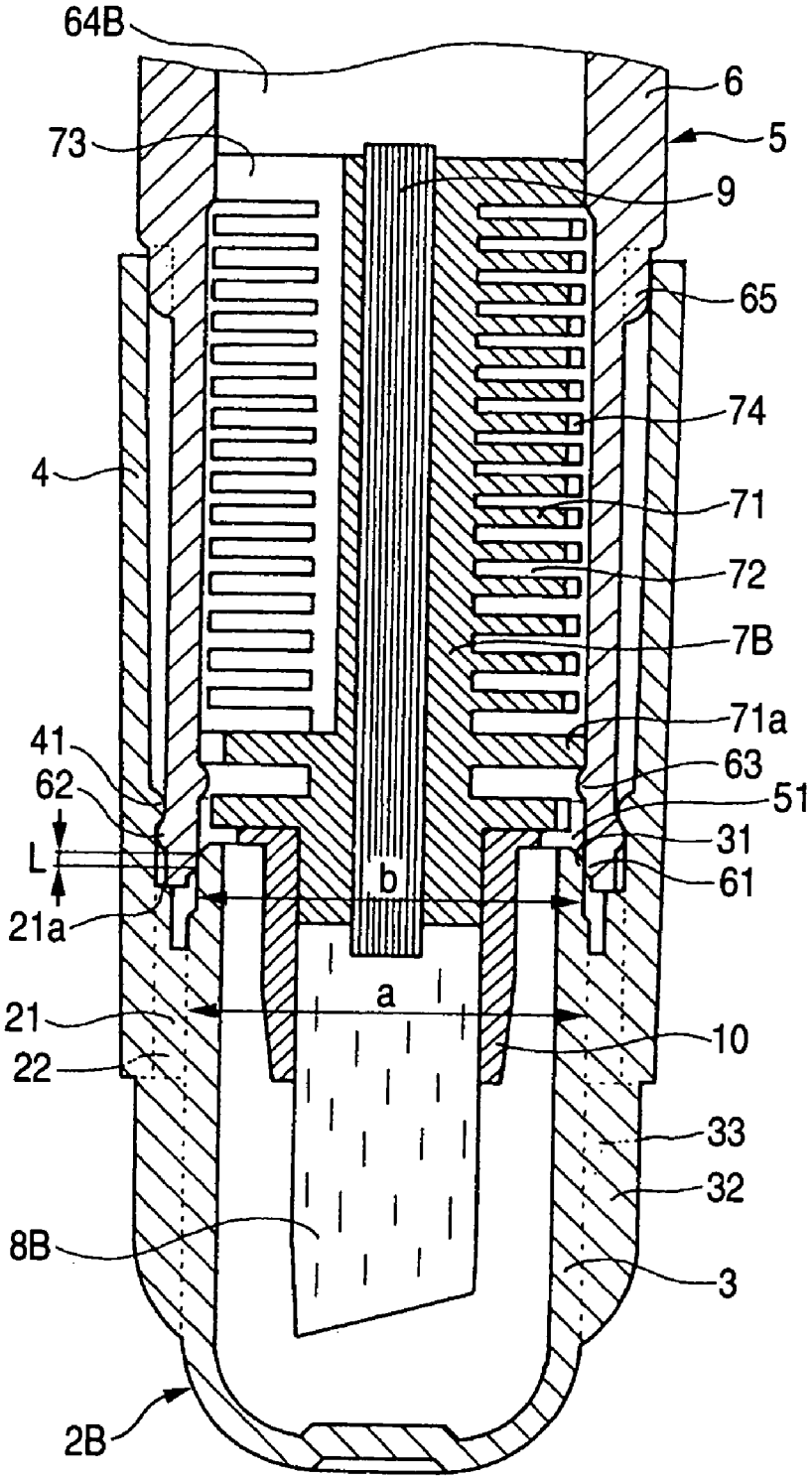
FIG. 8 is a longitudinal cross-sectional view of essential portions illustrating the cap fitted state of the other pen tip side shown in FIG. 7.
Figure 9:
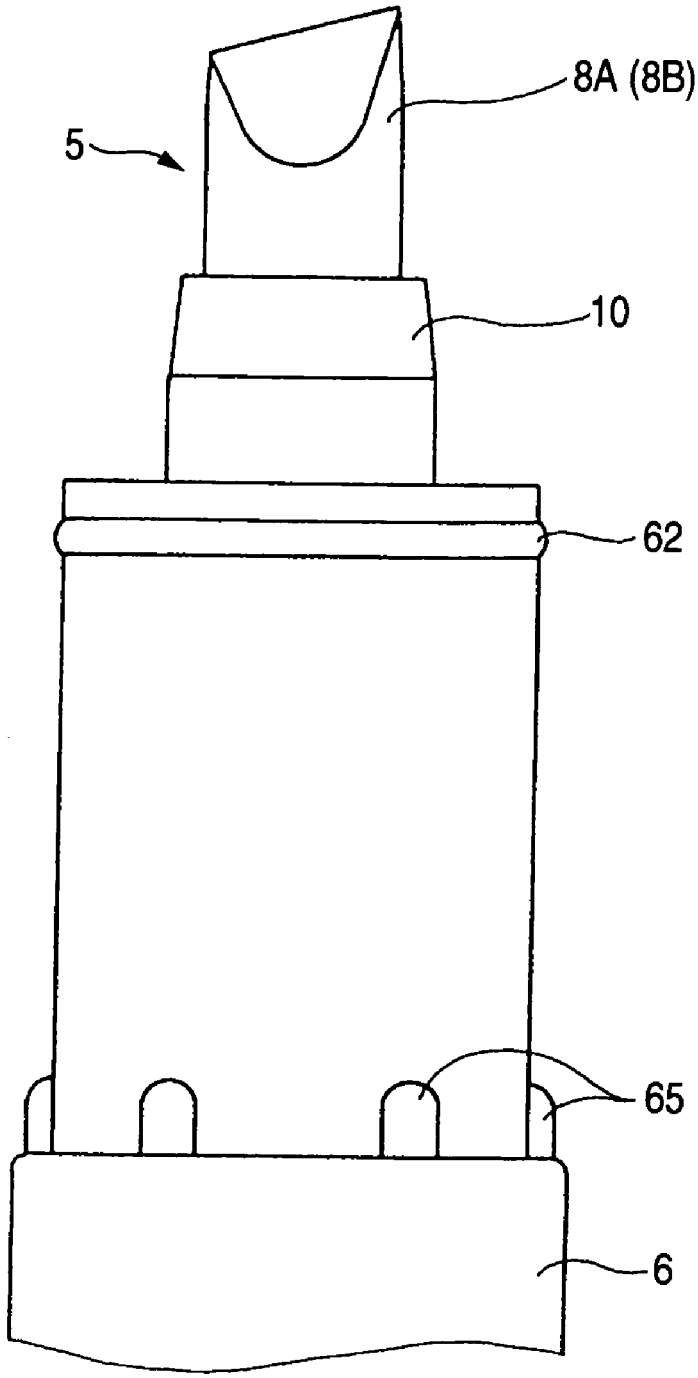
FIG. 9 is a front elevational view of essential portions of the writing instrument body shown in FIG. 7.

FIGS. 7 to 9 illustrate a second embodiment of the writing instrument 1 in accordance with the invention. The writing instrument 1 of this embodiment is comprised of the writing instrument body 5 having pen tips (i.e., a first pen tip 8A and a second pen tip 8B) at both ends, as well as two caps (i.e., a first cap 2A and a second cap 2B) which are detachably fitted to the pen tip sides of the writing instrument body 5.

(First Cap)

The first cap 2A has a construction substantially similar to that of the first embodiment. Namely, the first cap 2A is obtained by injection molding of a synthetic resin (e.g., polypropylene resin, polyethylene resin, polyester resin, polycarbonate resin, ABS resin, or the like). The first cap 2A is comprised of the bottomed cylindrical inner cylinder portion 3 with its front end closed and its rear end open; the cylindrical outer cylinder portion 4 which is connected to the outer peripheral surface of the inner cylinder portion 3 by means of the plurality of connection ribs 21 extending in the axial direction, and whose opposite ends are open; and the clip 23 which is integrally provided continuously on the outer surface of the outer cylinder portion 4 and extending in the axial direction. The projection 24 is formed on the outer surface of the outer cylinder portion 4 which faces the reverse surface of the clip 23.

The rear end opening portion of the inner cylinder portion 3 projects rearwardly of the rear ends of the connection ribs 21. The annular seal portion 31 constituted by an annular smooth surface is integrally formed on the outer peripheral surface of the rear end opening portion of the inner cylinder portion 3. The outside diameter b of the annular seal portion 31 is set to be smaller than the outside diameter a of the inner cylinder portion 3 between the connection ribs 21 (i.e., the outside diameter a of the outer peripheral surface of the inner cylinder portion 3 on the inner side of vent holes 22). Therefore, at the time of mold release in injection molding, the core of a mold for molding the connection ribs 21 is prevented from coming into contact with the annular seal portion 31 after molding, and from damaging the annular seal portion 31. It should be noted that the annular seal portion 31 may be formed by an annular protrusion.

The axially extending vent holes 22 are respectively provided penetratingly between adjacent ones of the connection ribs 21, and rear ends of the vent holes 22 communicate with the annular gap between the outer peripheral surface of the rear end portion of the inner cylinder portion 3 and the inner peripheral surface of the outer cylinder portion 4. In this embodiment, six connection ribs 21 are provided at equal intervals, with the result that six vent holes 22 are formed. The outer-cylinder-portion connecting side of the rear end portion of each connection rib 21 extends more rearwardly than the inner-cylinder-portion connecting side thereof, and is located slightly forwardly of the annular seal portion 31 (an opening end of the inner cylinder portion 3). The outer-cylinder-portion connecting side of the rear end portion of each connection rib 21 serves as the abutment wall portion 21*a* for abutment against the front end of the barrel 6 when the cap is fitted. The inner-cylinder-portion connecting side of the rear end portion of each connection rib 21 is located sufficiently forwardly of the opening end of the inner cylinder portion 3. Therefore, when the annular seal portion 31 on the outer peripheral surface of the inner cylinder portion 31 and the annular airtight portion 61 on the inner peripheral surface of the barrel 6 are fitted to each other, the elastic deformation of the annular seal portion 31 in the radially inward direction is facilitated. In addition, the circumferential thickness of only the connection rib 21 located in the vicinity of the attached proximal portion of the clip 23 is set to be large, so that the attachment strength of the clip 23 is improved.

In addition, the plurality of (specifically, four) axially extending longitudinal ribs 32 are integrally formed at equal intervals on the outer peripheral surface of the inner cylinder portion 3 forwardly of the connection ribs 21. The rear ends of the longitudinal ribs 32 are connected to the front ends of the outer cylinder portion 4. Further, the vent grooves 33 are respectively formed between adjacent ones of the longitudinal ribs 32, and rear ends of the vent grooves 33 communicate with front ends of the vent holes 22 between the connection ribs 21.

In addition, the annular inwardly oriented protrusion 41 is integrally formed on the inner peripheral surface of the outer cylinder portion 4 located slightly rearwardly of the annular seal portion 31. When the cap is fitted, the inwardly oriented protrusion 41 rides over and is engaged with the outwardly oriented protrusion 62 of the barrel 6.

(Second Cap)

The second cap 2B has a construction similar to that of the first cap 2A except for the construction of the clip 23 and the projection 24.

As for the first cap 2A and the second cap 2B of this embodiment, even in the event that an infant swallows the first cap 2A and the second cap 2B of this embodiment by mistake, it is possible to secure axial air passages by virtue of the interior of the outer cylinder portion 4, the annular gap between the outer peripheral surface of the rear end portion of the inner cylinder portion 3 and the inner peripheral surface of the outer cylinder portion 4, the vent holes 22 between the connection ribs 21, and the vent grooves 33 between the longitudinal ribs 32. In addition, since each of the first cap 2A and the second cap 2B of this embodiment has the annular seal portion 31 on the outer peripheral surface of the rear end opening portion of the inner cylinder portion 3, each of the pen tip 8A and the pen tip 8B is prevented from being brought into contact with the annular seal portion 31.

(Writing Instrument Body)

The writing instrument body 5 of this embodiment is comprised of the cylindrical barrel 6 whose both ends are open and which has a partition wall inside it; a first ink reservoir member 7A and a second ink reservoir member 7B each consisting of the plurality of comb teeth 71 which are fitted in the respective opening portions of the barrel 6; and the first pen tip 8A and the second pen tip 8B which are held at the respective front ends of the first ink reservoir member 7A and the second ink reservoir member 7B. FIG. 9 shows structures of both end portions the writing instrument body 5. The structures of both end portions of the writing instrument body 5, i.e., the first pen tip 8A and the second pen tip 8B are identical, the first ink reservoir member 7A and the second ink reservoir member 7B are identical, and front end portions of the barrel 6 are identical.

The barrel 6 is obtained by injection molding of a synthetic resin (e.g., polypropylene resin). The partition wall (not shown) is formed inside the barrel 6, and the arrangement provided is such that one opening portion of the barrel 6 and the other opening portion of the barrel 6 (i.e., a first ink tank 64A and a second ink tank 64B) do not communicate with each other by means of the partition wall.

The first ink tank 64A for directly storing the ink is formed in the rear of the first ink reservoir member 7A inside the barrel 6. The second ink tank 64B for directly storing the ink is formed in the rear of the second ink reservoir member 7B inside the barrel 6. The annular recess 51 which is forwardly open is formed in the respective front-end opening portion of the barrel 6. The annular recess 51 exposes the inner peripheral surface of the front-end opening portion of the barrel 6, and the annular airtight portion 61 constituted by an annular smooth surface is integrally formed on the inner peripheral surface of the respective front-end opening portion of the barrel 6. It should be noted that the annular airtight portion 61 may be an annular protrusion.

In addition, the outwardly oriented protrusion 62 is integrally formed on the outer peripheral surface of the barrel 6 slightly rearwardly of the respective annular airtight portion 61. When the cap is fitted, the outwardly oriented protrusion 62 rides over and is engaged with the inwardly oriented protrusion 41 of the outer cylinder portion 4. The rear surface of the outwardly oriented protrusion 62 is shaped in the form of an inclined surface (e.g., a tapered surface or a curved surface) in which its outside diameter becomes smaller toward the rear. As a result, in a state in which the inwardly oriented protrusion 41 has ridden over and has been engaged with the outwardly oriented protrusion 62 (i.e., in the cap fitted state), the front surface of the inwardly oriented protrusion 41 is set in a state of being pressed rearwardly by the rear surface of the outwardly oriented protrusion 62. Accordingly, in the cap fitted state, the abutment wall portion 21*a* and the front end of the barrel 6 abut against each other in the axial direction. At the same time, the inwardly oriented protrusion 41 is pressed rearwardly by the rear surface of the outwardly oriented protrusion 62. Hence, the rattling of the first cap 2A and the second cap 2B is prevented. It should be noted that either one of the inwardly oriented protrusion 41 and the outwardly oriented protrusion 62 may be formed by a plurality of circumferentially dispersed spot-like projections.

The annular detent protrusion 63 is integrally formed on the inner peripheral surface of the barrel 6 rearwardly of the respective outwardly oriented protrusion 62. The respective detent protrusion 63 rides over and is engaged with the supporting comb tooth 71*a* having a larger outside diameter than the other comb teeth 71 of each of the first ink reservoir member 7A and the second ink reservoir member 7B, thereby preventing the first ink reservoir member 7A and the second ink reservoir member 7B from coming off. Since the front end portion of the barrel 6 located forwardly of the respective detent protrusion 63 (i.e., the front end portion of the barrel 6 having the annular airtight portion 61 and the outwardly oriented protrusion 62) is in a state of noncontact with the first ink reservoir member 7A and the second ink reservoir member 7B, the insertion of the first ink reservoir member 7A and the second ink reservoir member 7B does not affect the inside dimension of the annular airtight portion 61 and the outside dimension of the outwardly oriented protrusion 62.

A plurality of (specifically, six) shaking-preventing projections 65, which are dispersed in the circumferential direction and constituted by spot-like projections, are integrally formed on the outer peripheral surface of the barrel 6 rearwardly of the respective detent projection 63. When the cap is fitted, the shaking-preventing projections 65 are brought into pressure contact with the inner peripheral surface of the opening portion of each of the first cap 2A and the second cap 2B. As a result of it, the radial shaking of the opening portions of the first cap 2A and the second cap 2B is prevented, so that the sealing characteristics of the annular airtight portion 61 and the annular seal portion 31 are made more stable.

The first ink reservoir member 7A and the second ink reservoir member 7B are obtained by injection molding of a synthetic resin (e.g., ABS resin). Each of the first ink reservoir member 7A and the second ink reservoir member 7B includes the plurality of disc-shaped comb teeth 71, the ink reservoir grooves 72 respectively formed between adjacent ones of the comb teeth 71; the ink guide slit 73 provided in such a manner as to penetrate the plurality of comb teeth 71 in the axial direction; and the notch-like air grooves 74 respectively formed in the comb teeth 71. In addition, the axial hole is penetratingly provided in the axial center of each of the first ink reservoir member 7A and the second ink reservoir member 7B, and the ink guide core 9 (e.g., a synthetic-resin extrusion molded part or a fiber-bundle resin processed part) is inserted and fitted in the axial hole of each of the first ink reservoir member 7A and the second ink reservoir member 7B.

Further, the first pen tip 8A (e.g., a fiber-bundle resin processed part) is fitted to the front end of the first ink reservoir member 7A by means of the annular pen-tip holding member 10. The second pen tip 8B (e.g., a fiber-bundle resin processed part) is fitted to the front end of the second ink reservoir member 7B by means of the annular pen-tip holding member 10. The respective annular pen-tip holding member 10 holds the outer peripheral surface of the rear portion of each of the first pen tip 8A and the second pen tip 8B, and is fitted over the outer peripheral surface of the front end portion of each of the first ink reservoir member 7A and the second ink reservoir member 7B. The front end of the respective ink guiding core 9 pierces the rear end of each of the first pen tip 8A and the second pen tip 8B and is connected thereto, while the rear end of the respective ink guiding core 9 is exposed in each of the first ink tank 64A and the second ink tank 64B.

The axial close-contact sliding length L between the annular seal portion 31 and the annular airtight portion 61 (namely, the axial close-contact sliding length L from the time the close contact between the annular seal portion 31 and the annular airtight portion 61 is started until it is completed) should preferably be in the range of 0.1 mm to 1.0 mm (preferably, 0.1 mm to 0.5 mm). As a result of it, a sufficient sealing characteristic is obtained between the annular seal portion 31 and the annular airtight portion 61, and it is possible to sufficiently avoid pressurizing the air inside the inner cylinder portion 3 when the cap is fitted. If the close-contact sliding length L is smaller than 0.1 mm, a sufficient sealing characteristic cannot be obtained between the annular seal portion 31 and the annular airtight portion 61, and there is a possibility that the sealing of the first pen tip 8A and the second pen tip 8B becomes incomplete. On the other hand, if the close-contact sliding length L is greater than 1.0 mm, there is a possibility that when the cap is fitted, the air inside the inner cylinder portion 3 is pressurized, and the pressurized air enters the first ink tank 64A and the second ink tank 64B. Incidentally, in this embodiment, the close-contact sliding length L is set to 0.3 mm.

As described above, the structures for fitting the writing instrument body 5 and both the first cap 2A and the second cap 2B become structures which render separate members such as annular resilient members and the like unnecessary, bring down the manufacturing cost, and practically do not pressurize the air inside the inner cylinder portion 3.

The first cap 2A can be fitted to either the first pen tip 8A side or the second pen tip 8B side of the writing instrument body 5. The second cap 2B can similarly be fitted to either the first pen tip 8A side or the second pen tip 8B side of the writing instrument body 5.

The inner peripheral surface of the opening portion of the outer cylinder portion 4 of the second cap 2B can be fitted on the outer peripheral surfaces of the longitudinal ribs 32 of the first cap 2A. The inner peripheral surface of the opening portion of the outer cylinder portion 4 of the first cap 2A can be fitted on the outer peripheral surfaces of the longitudinal ribs 32 of the second cap 2B.

The outside diameter of the longitudinal ribs 32 of the first cap 2A and the longitudinal ribs 32 of the second cap 2B (i.e., the diameter of the circumscribed circle) on the one hand, and the shaking-preventing projections 65 on the first pen tip 8A side and the shaking-preventing projections 65 on the second pen tip 8B side on the other hand, are set to be substantially identical. As a result of it, the inner peripheral surface of the opening portion of the outer cylinder portion 4 of the first cap 2A can be fitted on the outer peripheral surfaces of the longitudinal ribs 32 of the second cap 2B, the outer peripheral surfaces of the shaking-preventing projections 65 on the first pen tip 8A side, and the outer peripheral surfaces of the shaking-preventing projections 65 on the second pen tip 8B side. At the same time, the inner peripheral surface of the opening portion of the outer cylinder portion 4 of the second cap 2B can be fitted on the outer peripheral surfaces of the longitudinal ribs 32 of the first cap 2A, the outer peripheral surfaces of the shaking-preventing projections 65 on the first pen tip 8A side, and the outer peripheral surfaces of the shaking-preventing projections 65 on the second pen tip 8B side.

[Third Embodiment]

Figure 10:
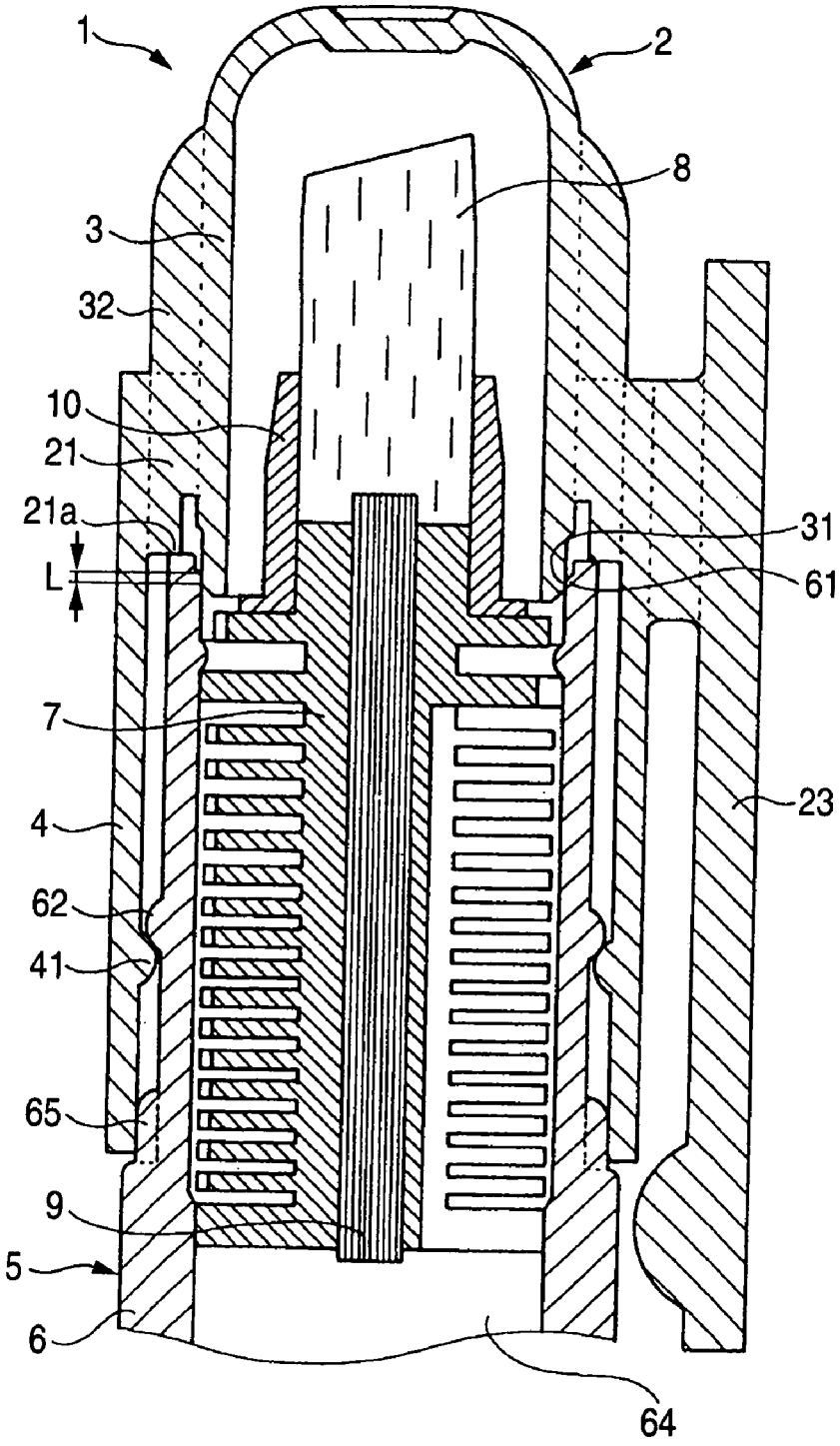
FIG. 10 is a longitudinal cross-sectional view of essential portions illustrating the cap fitted state in accordance with a third embodiment of the invention.
Figure 11:
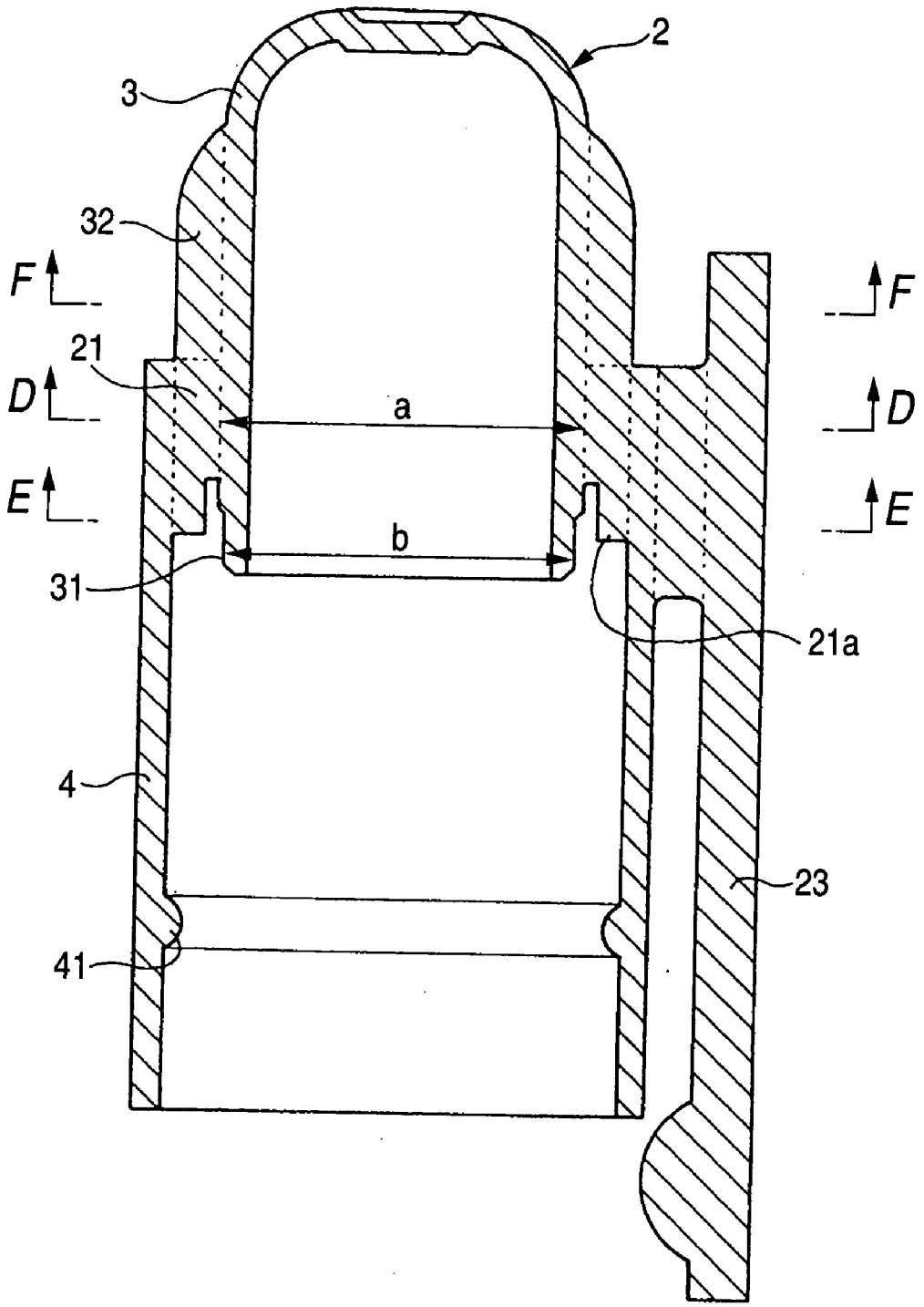
FIG. 11 is a longitudinal cross-sectional view illustrating the cap shown in FIG. 10.
Figure 12:
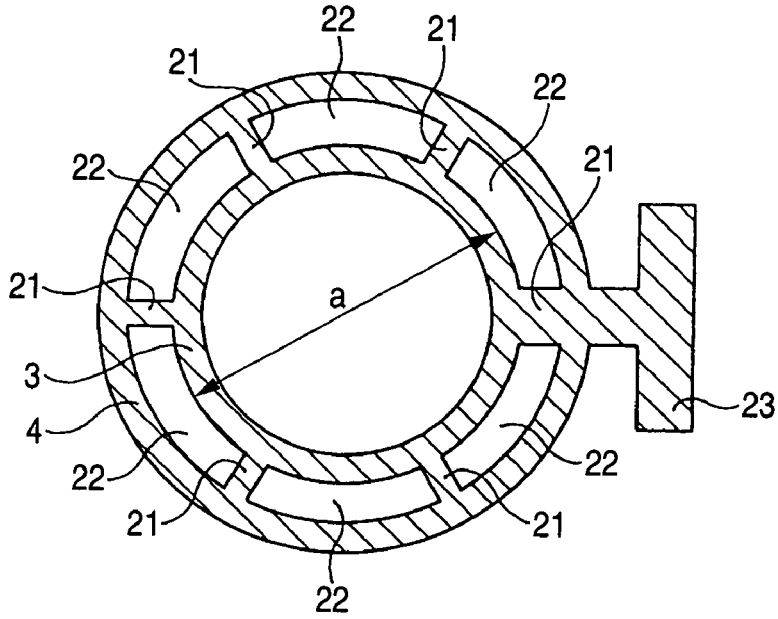
FIG. 12 is a cross-sectional view taken along line D—D in FIG. 11.
Figure 13:
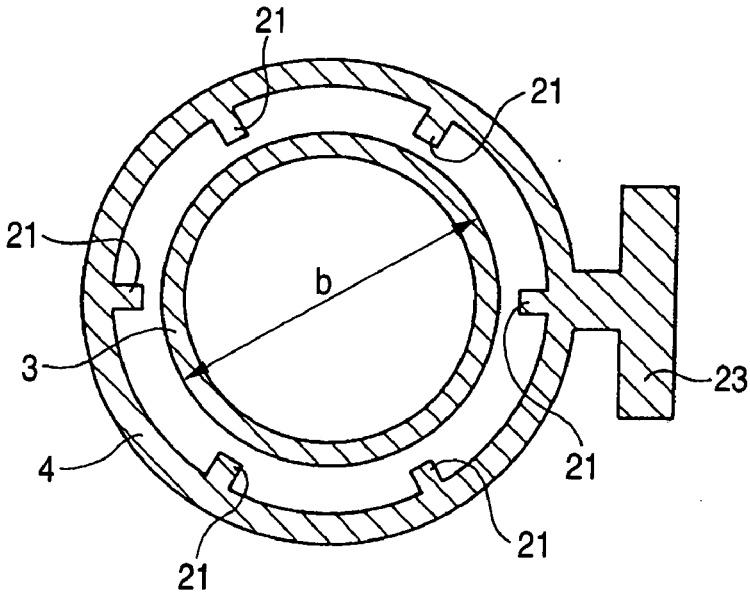
FIG. 13 is a cross-sectional view taken along line E—E in FIG. 11.
Figure 14:
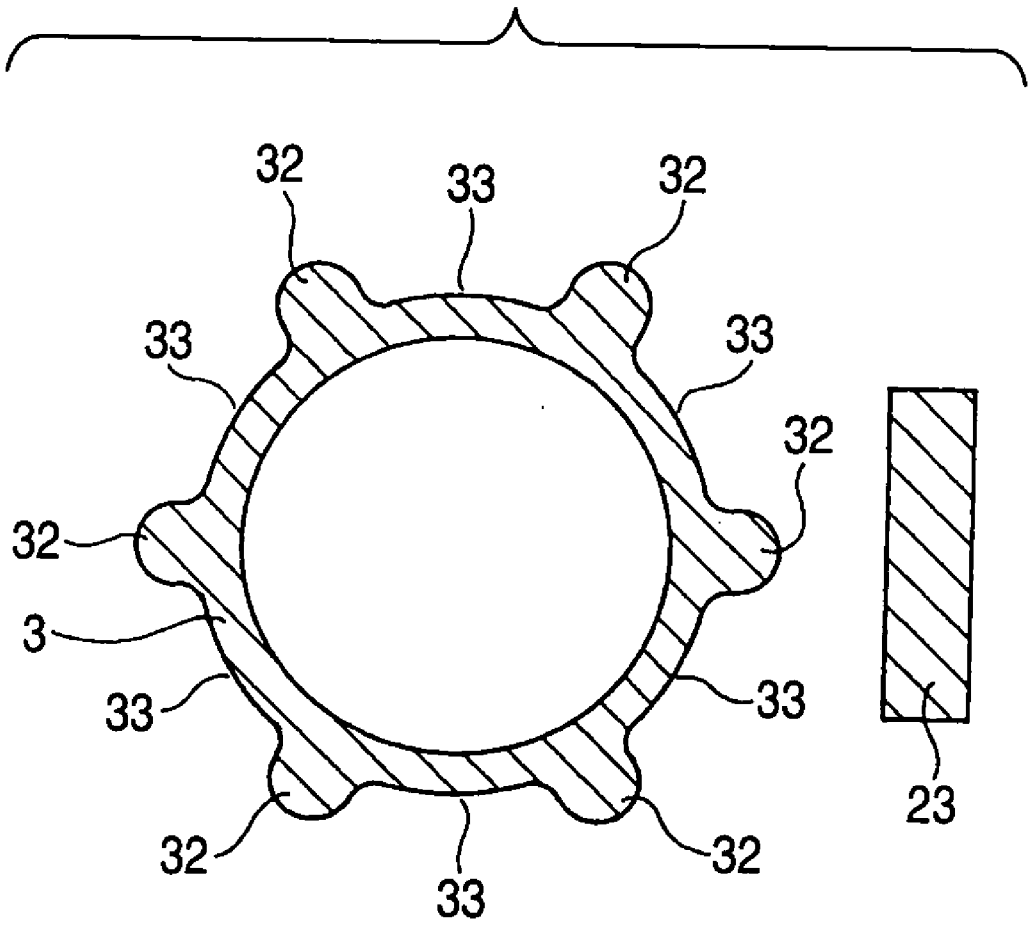
FIG. 14 is a cross-sectional view taken along line F—F in FIG. 11.

FIGS. 10 to 15 illustrate a third embodiment of the writing instrument 1 in accordance with the invention. In this embodiment, the writing instrument 1 is comprised of the cap 2 and the writing instrument body 5, the cap 2 being detachably fitted to the pen tip side of the writing instrument body 5. FIG. 10 shows a state in which the cap 2 is fitted on the pen tip side of the writing instrument body 5.

(Cap)

FIGS. 11 to 14 illustrate the cap 2 in accordance with this embodiment. The cap 2 is obtained by injection molding of a synthetic resin (e.g., polypropylene resin, polyethylene resin, polyester resin, polycarbonate resin, ABS resin, or the like). The cap 2 is comprised of the bottomed cylindrical inner cylinder portion 3 with its front end closed and its rear end open; the cylindrical outer cylinder portion 4 which is connected to the outer peripheral surface of the inner cylinder portion 3 by means of the plurality of connection ribs 21 extending in the axial direction, and whose opposite ends are open; and the clip 23 which is integrally provided continuously on the outer surface of the outer cylinder portion 4 and extending in the axial direction.

The rear end opening portion of the inner cylinder portion 3 projects rearwardly of the rear ends of the connection ribs 21. The annular seal portion 31 constituted by an annular smooth surface is integrally formed on the outer peripheral surface of the rear end opening portion of the inner cylinder portion 3. The outside diameter b of the annular seal portion 31 is set to be smaller than the outside diameter a of the inner cylinder portion 3 between the connection ribs 21 (i.e., the outside diameter a of the outer peripheral surface of the inner cylinder portion 3 on the inner side of vent holes 22). Therefore, at the time of mold release in injection molding, the core of a mold for molding the connection ribs 21 is prevented from coming into contact with the annular seal portion 31 after molding, and from damaging the annular seal portion 31. It should be noted that the annular seal portion 31 may be formed by an annular protrusion.

The axially extending vent holes 22 are respectively provided penetratingly between adjacent ones of the connection ribs 21, and rear ends of the vent holes 22 communicate with the annular gap between the outer peripheral surface of the rear end portion of the inner cylinder portion 3 and the inner peripheral surface of the outer cylinder portion 4. In this embodiment, six connection ribs 21 are provided at equal intervals, with the result that six vent holes 22 are formed. The outer-cylinder-portion connecting side of the rear end portion of each connection rib 21 extends more rearwardly than the inner-cylinder-portion connecting side thereof, and is located slightly forwardly of the annular seal portion 31 (an opening end of the inner cylinder portion 3). The outer-cylinder-portion connecting side of the rear end portion of each connection rib 21 serves as the abutment wall portion 21*a* for abutment against the front end of the barrel 6 when the cap is fitted. The inner-cylinder-portion connecting side of the rear end portion of each connection rib 21 is located sufficiently forwardly of the opening end of the inner cylinder portion 3. Therefore, when the annular seal portion 31 on the outer peripheral surface of the inner cylinder portion 31 and the annular airtight portion 61 on the inner peripheral surface of the barrel 6 are fitted to each other, the elastic deformation of the annular seal portion 31 in the radially inward direction is facilitated. In addition, the circumferential thickness of only the connection rib 21 located in the vicinity of the attached proximal portion of the clip 23 is set to be large, so that the attachment strength of the clip 23 is improved.

In addition, the plurality of (specifically, six) axially extending longitudinal ribs 32 are integrally formed at equal intervals on the outer peripheral surface of the inner cylinder portion 3 forwardly of the connection ribs 21. The rear ends of the longitudinal ribs 32 are connected to the front ends of the connection ribs 21. Further, the vent grooves 33 are respectively formed between adjacent ones of the longitudinal ribs 32, and rear ends of the vent grooves 33 communicate with front ends of the vent holes 22 between the connection ribs 21.

In addition, the annular inwardly oriented protrusion 41 is integrally formed rearwardly of the annular seal portion 31 on the inner peripheral surface of a rear portion or an intermediate portion of the outer cylinder portion 4. When the cap is fitted, the inwardly oriented protrusion 41 rides over and is engaged with the outwardly oriented protrusion 62 of the barrel 6.

Even in the event that an infant swallows the cap 2 of this embodiment by mistake, it is possible to secure axial air passages by virtue of the interior of the outer cylinder portion 4, the annular gap between the outer peripheral surface of the rear end portion of the inner cylinder portion 3 and the inner peripheral surface of the outer cylinder portion 4, the vent holes 22 between the connection ribs 21, and the vent grooves 33 between the longitudinal ribs 32. In addition, since the cap 2 of this embodiment has the annular seal portion 31 on the outer peripheral surface of the rear end opening portion of the inner cylinder portion 3, the pen tip 8 is prevented from being brought into contact with the annular seal portion 31.

(Writing Instrument Body)

Figure 15:
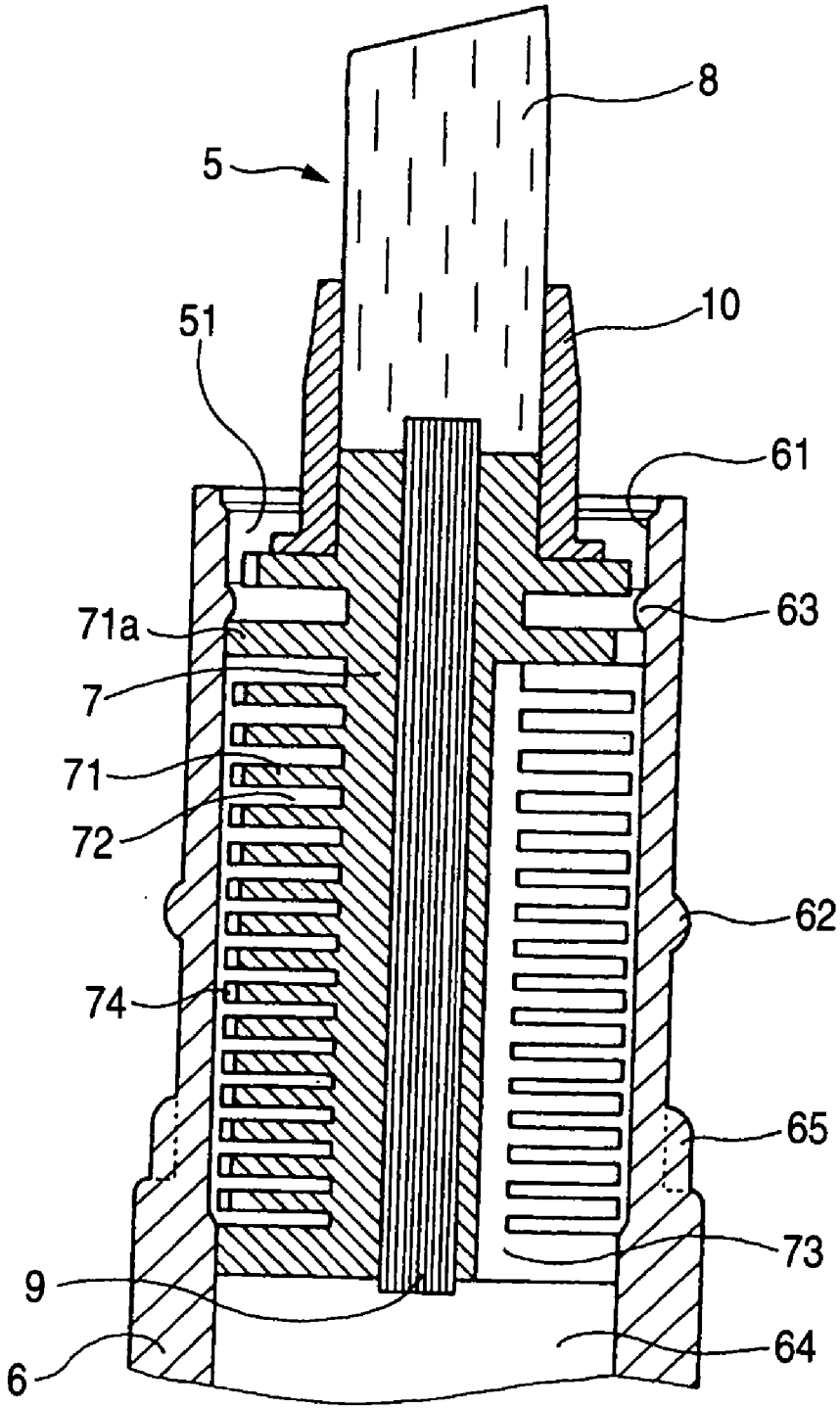
FIG. 15 is a longitudinal cross-sectional view of essential portions illustrating the writing instrument body shown in FIG. 10.

FIG. 15 shows the writing instrument body 5 in accordance with this embodiment. The writing instrument body 5 is comprised of the bottomed cylindrical barrel 6 with its front end open; the ink reservoir member 7 consisting of the plurality of comb teeth 71 which are fitted in the front-end opening portion of the barrel 6; the pen tip 8 which is held at the front end of the ink reservoir member 7; and the ink guiding core 9 connected to the pen tip 8 and inserted and fitted in the axial hole of the ink reservoir member 7.

The barrel 6 is obtained by injection molding of a synthetic resin (e.g., polypropylene resin). The ink tank 64 for directly storing the ink is formed in the rear of the ink reservoir member 7 inside the barrel 6. The annular recess 51 which is forwardly open is formed in the front-end opening portion of the barrel 6. The annular recess 51 exposes the inner peripheral surface of the front-end opening portion of the barrel 6, and the annular airtight portion 61 constituted by an annular smooth surface is integrally formed on the inner peripheral surface of the front-end opening portion of the barrel 6. It should be noted that the annular airtight portion 61 may be an annular protrusion.

An annular detent protrusion 63 is integrally formed on the inner peripheral surface of the barrel 6 rearwardly of the annular airtight portion 61. The detent protrusion 63 rides over and is engaged with the supporting comb tooth 71*a* having a larger outside diameter than the other comb teeth 71 of the ink reservoir member 7, thereby preventing the ink reservoir member 7 from coming off. Since the front end portion of the barrel 6 located forwardly of the detent protrusion 63 (i.e., the front end portion of the barrel 6 having the annular airtight portion 61) is in a state of noncontact with the ink reservoir member 7, the insertion of the ink reservoir member 7 does not affect the inside dimension of the annular airtight portion 61.

In addition, the outwardly oriented protrusion 62 is integrally formed on the outer peripheral surface of the barrel 6 rearwardly of the detent preventing protrusion 63. When the cap is fitted, the outwardly oriented protrusion 62 rides over and is engaged with the inwardly oriented protrusion 41 of the outer cylinder portion 4. The rear surface of the outwardly oriented protrusion 62 is shaped in the form of an inclined surface (e.g., a tapered surface or a curved surface) in which its outside diameter becomes smaller toward the rear. As a result, in a state in which the inwardly oriented protrusion 41 has ridden over and has been engaged with the outwardly oriented protrusion 62 (i.e., in the cap fitted state), the front surface of the inwardly oriented protrusion 41 is set in a state of being pressed rearwardly by the rear surface of the outwardly oriented protrusion 62. Accordingly, in the cap fitted state, the abutment wall portion 21*a* and the front end of the barrel 6 abut against each other in the axial direction. At the same time, the inwardly oriented protrusion 41 is pressed rearwardly by the rear surface of the outwardly oriented protrusion 62. Hence, the rattling of the cap 2 is prevented. It should be noted that either one of the inwardly oriented protrusion 41 and the outwardly oriented protrusion 62 may be formed by a plurality of circumferentially dispersed spot-like projections.

In this embodiment, since the inwardly oriented protrusion 41 is provided on the inner peripheral surface of a rear portion or an intermediate portion of the outer cylinder portion 4, the distance between the outwardly oriented protrusion 62 and the annular airtight portion 61 can be set to be relatively large. Because the distance between the outwardly oriented protrusion 62 and the annular airtight portion 61 can be set to be relatively large, even if the axial center of the outer peripheral surface of the barrel 6 and the axial center of the inner peripheral surface of the barrel 6 have been formed by being slightly offset, it is possible to obviate the effect of the offset of the axial center, and suppress the occurrence of faulty sealing characteristics of the annular airtight portion 61 and the annular seal portion 31.

In the same way as FIG. 9, the plurality of shaking-preventing projections 65, which are dispersed in the circumferential direction and constituted by spot-like projections, are integrally formed on the outer peripheral surface of the barrel 6 rearwardly of the outwardly oriented protrusion 62. When the cap is fitted, the shaking-preventing projections 65 are brought into pressure contact with the inner peripheral surface of the opening portion of the cap 2. As a result of it, the radial shaking of the opening portion of the cap 2 is prevented, so that the sealing characteristics of the annular airtight portion 61 and the annular seal portion 31 are made more stable.

The ink reservoir member 7 is obtained by injection molding of a synthetic resin (e.g., ABS resin). The ink reservoir member 7 includes the plurality of disc-shaped comb teeth 71, the ink reservoir grooves 72 respectively formed between adjacent ones of the comb teeth 71; the ink guide slit 73 provided in such a manner as to penetrate the plurality of comb teeth 71 in the axial direction; and the notch-like air grooves 74 respectively formed in the comb teeth 71. In addition, the axial hole is penetratingly provided in the axial center of the ink reservoir member 7, and the ink guide core 9 (e.g., a synthetic-resin extrusion molded part or a fiber-bundle resin processed part) is inserted and fitted in the axial hole of the ink reservoir member 7. Further, the pen tip 8 (e.g., a fiber-bundle resin processed part) is fitted to the front end of the ink reservoir member 7 by means of the annular pen-tip holding member 10. The annular pen-tip holding member 10 holds the outer peripheral surface of the rear portion of the pen tip 8, and is fitted over the outer peripheral surface of the front end portion of the ink reservoir member 7. The front end of the ink guiding core 9 pierces the rear end of the pen tip 8 and is connected thereto, while the rear end of the ink guiding core 9 is exposed in the ink tank 64.

The axial close-contact sliding length L between the annular seal portion 31 and the annular airtight portion 61 (namely, the axial close-contact sliding length L from the time the close contact between the annular seal portion 31 and the annular airtight portion 61 is started until it is completed) should preferably be in the range of 0.1 mm to 1.0 mm (preferably, 0.1 mm to 0.5 mm). As a result of it, a sufficient sealing characteristic is obtained between the annular seal portion 31 and the annular airtight portion 61, and it is possible to sufficiently avoid pressurizing the air inside the inner cylinder portion 3 when the cap is fitted. If the close-contact sliding length L is smaller than 0.1 mm, a sufficient sealing characteristic cannot be obtained between the annular seal portion 31 and the annular airtight portion 61, and there is a possibility that the sealing of the pen tip 8 becomes incomplete. On the other hand, if the close-contact sliding length L is greater than 1.0 mm, there is a possibility that when the cap is fitted, the air inside the inner cylinder portion 3 is pressurized, and the pressurized air enters the ink tank 64. Incidentally, in this embodiment, the close-contact sliding length L is set to 0.3 mm.

As described above, the structure for fitting the writing instrument body 5 and the cap 2 becomes a structure which renders separate members such as an annular resilient member and the like unnecessary, brings down the manufacturing cost, and practically does not pressurize the air inside the inner cylinder portion 3.

It should be noted that, in the invention, the pen tips 8, 8A, and 8B may be, in addition to the fiber-bundle resin processed pen tips, any of ballpoint pen tips having a ball at the tip rotatably, fountain pen-like metallic plate-made pen tips having a slit at the nib, pen tips formed of a porous material of a synthetic resin, pen tips formed of a synthetic-resin extruded part having an axial ink guide passage, writing brush pen tips, and the like.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

Even in the event that an infant swallows the cap 2, 2A, or 2B by mistake, it is possible to secure air passages in the axial direction by virtue of the plurality of vent holes 22 formed between adjacent ones of the connection ribs 21 between the inner cylinder portion 3 and the outer cylinder portion 4 in the first aspect of the present invention. In addition, the annular seal portion 31 which is brought into close contact with the annular airtight portion 61 on the pen tip side of the writing instrument body 5 is provided on the outer peripheral surface of the open end portion of the inner cylinder portion 3 in the first aspect of the present invention. Therefore, when the cap 2, 2A, or 2B is fitted on the pen tip side of the writing instrument body 5, in a case where the pen tip 8, 8A, or 8B is inserted into the cap 2, 2A, or 2B diagonally with respect to the axis of the cap 2, 2A, or 2B, the pen tip 8, 8A, or 8B may come into contact with the inner peripheral surface of the inner cylinder portion 3 or the inner peripheral surface of the outer cylinder portion 4, but has at least no possibility of coming into contact with the outer peripheral surface of the inner cylinder portion 3 (i.e., the annular seal portion 31). Consequently, it is possible to prevent the ink from attaching to and smearing the annular seal portion 31. At the same time, it is possible to avoid damaging the annular seal portion 31 and prevent the occurrence of faulty airtightness of the annular seal portion 31.

According to the second aspect of the present invention according to the second aspect of the present invention, in the process in which the cap 2, 2A, or 2B is fitted on the pen tip side of the writing instrument body 5, from the time the pen tip side of the barrel 6 is inserted through the opening portion of the outer cylinder portion 4 until immediately before the annular seal portion 31 of the inner cylinder portion 3 and the annular airtight portion 61 of the barrel 6 start to contact each other, the interior of the cap 2, 2A, or 2B positively communicates with the outside through the vent holes 22. In addition, since the annular seal portion 31 is provided on the rear end opening portion of the inner cylinder portion 3 (the open end portion of the inner cylinder portion 3), and the annular airtight portion 61 is provided on the front end opening portion of the barrel 6, the axial length in which the outer peripheral surface of the inner cylinder portion 3 and the inner peripheral surface of the barrel 6 overlap can be minimized, thereby making it possible to prevent the air inside the inner cylinder portion 3 from being pressurized when the cap is fitted. As a result, when the cap 2, 2A, or 2B is fitted on the pen tip side of the writing instrument body 5, pressurized air does not enter the ink tank 64 inside the barrel 6, so that there is no possibility of the ink leaking to the outside from the front portion of the ink reservoir member 7. Further, since it is unnecessary to provide a conventional annular resilient member, which is a separate part, the numbers of parts and manufacturing steps decrease, so that it is possible to reduce the manufacturing cost and provide the writing instrument at low cost.

In addition, by virtue of the arrangement in the second aspect of the present invention in which the outwardly oriented protrusion 62 is provided on the outer peripheral surface of the barrel 6 rearwardly of the annular airtight portion 61, the annular airtight portion 61 and the outwardly oriented protrusion 62 are provided in such a manner as to be positionally offset in the axial direction. As a result, when the cap 2, 2A, or 2B is fitted on the pen tip side of the barrel 6, it is possible to prevent the inside dimension of the annular airtight portion 61 from becoming small due to the fitting of the inwardly oriented protrusion 41 and the outwardly oriented protrusion 62, and prevent the outside dimension of the outwardly oriented protrusion 62 from becoming large due to the fitting of the annular airtight portion 61 and the annular seal portion 31. Namely, it is possible to obviate the mutually imparted effect of a radial dimensional change occurring between the annular airtight portion 61 and the outwardly oriented protrusion 62 at the time of fitting.

In the first aspect of the present invention, if the annular seal portion is arranged to be provided on an outer peripheral surface of the inner cylinder portion rearwardly of the connection ribs, when during the molding of the cap, a core of a mold for molding the connection ribs and the annular seal portion is pulled out rearwardly from the cap after molding, connection-rib molding portions of the core of the mold can come into contact with the annular seal portion on the outer peripheral surface of the inner cylinder portion and damage the annular seal portion. Hence, there is a possibility that proper sealing characteristics cannot be obtained between the annular seal portion and the annular airtight portion of the writing instrument body.

However, according to the third aspect of the present invention according to the first aspect of the present invention, the outside diameter b of the annular seal portion 31 is set to be smaller than the outside diameter a of the inner cylinder portion 3 between the connection ribs 21 (i.e., the outside diameter a of the inner cylinder portion 3 on the inner side of the vent holes 22) (i.e., a>b). Therefore, when the core of a mold for molding the cap is pulled out rearwardly from the cap 2, 2A, or 2B, portions for molding the connection ribs 21 (i.e., the vent holes 22) of the core of the mold are prevented from coming into contact with the annular seal portion 31 after molding, thereby making it possible to prevent causing damage to the annular seal portion 31.

What is claimed is:

1. A writing instrument comprising:

a cap including:

an inner cylinder portion having an open end and a close end;

a outer cylinder portion having open ends;

a plurality of connection rib that extends in an axial direction of the cap, the connection ribs integrally connecting an outer surface of the inner cylinder portion and the outer cylinder portion; and a plurality of vent hole respectively formed between adjacent ones of the connection ribs; and a writing instrument body including a pen tip, wherein the open end of the inner cylinder portion rearwardly extends beyond the connection ribs, the inner cylinder portion seals the pen tip when the cap is fitted on a pen tip side of the writing instrument body and an annular seal portion which closely contacts with an annular airtight portion on the pen tip side of the writing instrument body is provided on the outer peripheral surface of the open end of the inner cylinder portion.

2. The writing instrument as set forth in claim 1, wherein the writing instrument body further comprises:

an ink reservoir member having the pen tip at a front end thereof;

a barrel in which the ink reservoir member is accommodated in a front portion thereof;

an ink tank formed rearwardly of the ink reservoir member inside the barrel, wherein the ink reservoir member is adapted to temporarily store excess ink corresponding to a rise in the internal pressure within the ink tank, the annular airtight portion is provided on an inner peripheral surface of an opening portion of a front end of the barrel, an outwardly oriented protrusion is provided on an outer peripheral surface of the barrel rearwardly of the annular airtight portion, and an inwardly oriented protrusion for riding over and being engaged with the outwardly oriented protrusion is provided on an inner peripheral surface of the outer cylinder portion rearwardly of the annular seal portion of the cap.

3. The writing instrument as set forth in claim 2, wherein a rear surface of the outwardly oriented protrusion is an inclined surface in such a manner that the outside diameter of the outwardly oriented protrusion becomes smaller toward the rear of the cap.

4. The writing instrument as set forth in claim 2, wherein a plurality of shaking-preventing spot-like projection dispersed in a circumferential direction are integrally formed on the outer peripheral surface of the barrel rearwardly of the outwardly oriented protrusion.

5. The writing instrument as set forth in claim 2, wherein a detent protrusion is integrally formed on the inner peripheral surface of the barrel rearwardly of the annular airtight portion, the detent protrusion rides over and is engaged with the ink reservoir member.

6. The writing instrument as set forth in claim 5, wherein the detent protrusion is formed rearwardly of the outwardly oriented protrusion.

7. The writing instrument as set forth in claim 5, wherein the detent protrusion is formed forwardly of the outwardly oriented protrusion.

8. The writing instrument as set forth in claim 1, wherein the outside diameter of the annular seal portion is smaller than the outside diameter of the inner cylinder portion between the connection ribs.

9. The writing instrument as set forth in claim 1, wherein the cap is made of a synthetic-resin.

10. The writing instrument as set forth in claim 9, wherein the synthetic-resin is selected from at least one of polypropylene resin, polyethylene resin, polyester resin, polycarbonate resin or ABS resin.

11. The writing instrument as set forth in claim 1, wherein the cap is formed by an injection molding method.

12. The writing instrument as set forth in claim 1, wherein the cap further includes:

a clip integrally formed on the outer surface of the outer cylinder portion, the clip extending to an axial direction, wherein a circumferential thickness of the connection rib located in the vicinity of an attached proximal portion of the clip is larger than the thickness of the other connection ribs.

13. The writing instrument as set forth in claim 1, wherein a plurality of axially extending longitudinal ribs is integrally formed on the outer peripheral surface of the inner cylinder portion.

14. The writing instrument as set forth in claim 13, wherein the rear ends of the axially extending longitudinal ribs connect to the front ends of the outer cylinder.

15. The writing instrument as set forth in claim 14, wherein a plurality of vent groove are formed between the respective axially extending longitudinal ribs, and the rear ends of the vent grooves connect to a front end of the vent hole of the connection ribs.

16. The writing instrument as set forth in claim 1, wherein the annular airtight portion is an annular smooth surface.

17. The writing instrument as set forth in claim 1, wherein the annular airtight portion is an annular protrusion.

18. The writing instrument as set forth in claim 1, wherein an axial close-contact sliding length defined between the annular seal portion and the annular airtight portion is in a range of 0.1 mm to 1.0 mm.

19. The writing instrument as set forth in claim 18, wherein the axial close-contact sliding length is in a range of 0.1 mm to 0.5 mm.

20. The writing instrument as set forth in claim 1, wherein the pen tip is made of a fiber-bundle resin processed part.

21. The writing instrument as set forth in claim 1, wherein the annular seal portion is constituted by an annular smooth surface.

22. The writing instrument as set forth in claim 1, wherein the annular seal portion is formed by an annular protrusion.

23. The writing instrument as set forth in claim 1, wherein an outer-cylinder-portion connecting side of a rear end portion of the connection rib is extended and provided rearwardly of an inner-cylinder-portion connecting side of the connection rib.

24. The writing instrument as set forth in claim 23, wherein the outer-cylinder-portion connecting side of the rear end portion of the connection rib serves as an abutment wall portion for abutment against the pen tip side of the writing instrument body when the cap is fitted.

* * * * *